United States Patent [19]

Satoh

[11] 4,009,766

[45] Mar. 1, 1977

[54] ELEVATOR CONTROL SYSTEM

[75] Inventor: Tsuyoshi Satoh, Inazawa, Japan

[73] Assignee: Mitsubishi Denki Kabushiki Kaisha, Tokyo, Japan

[22] Filed: Feb. 7, 1975

[21] Appl. No.: 548,079

[30] Foreign Application Priority Data

Feb. 21, 1974 Japan ..... 49-21093

[52] U.S. Cl. ..... 187/29 R

[51] Int. Cl.[2] ..... B66B 3/02

[58] Field of Search ..... 187/29

[56] References Cited

UNITED STATES PATENTS

| | | | |
|---|---|---|---|
| 3,370,676 | 2/1968 | McDonald et al. | 187/29 |
| 3,590,355 | 6/1971 | Davis et al. | 187/29 |
| 3,779,346 | 12/1973 | Winkler | 187/29 |
| 3,783,974 | 1/1974 | Gilbert et al. | 187/29 |

*Primary Examiner*—Robert K. Schaefer
*Assistant Examiner*—W. E. Duncanson, Jr.

[57] ABSTRACT

A pulse generator supplies to a logic unit, pulses the number of which is determined by the amount of movement of an elevator car. The logic unit effects the algorithm and comparison of the amount of movement of the car and a command amount of movement of the car to produce a speed signal which, in turn, controls the car. The pulses are also stored in a memory and an electric source energizes the memory and the pulse generator for a predetermined time after the occurrence of an emergency.

3 Claims, 2 Drawing Figures

ELEVATOR CONTROL SYSTEM

BACKGROUND OF THE INVENTION

This invention relates to an elevator control system for controlling an elevator car in a digital manner to permit the car to be operated in the normal mode immediately after the end of an emergency such as an electric power failure.

It is well known that the control of elevator systems has been previously accomplished by operating the elevator car according to a miniature model including a small movable body representative of the elevator car and a small-sized replica of the shaft. That is, the elevator car has been operated under one kind of copy control relying on an analogue miniature model and the dimension of the model has been greatly restricted by both the technique of manufacturing it and the accuracy thereof. On the other hand, high buildings recently being built have encountered problems in the production and installation of miniature models because they become large-scaled. This has coincided with advances in the construction of electronic parts and has resulted in attempts to conduct the control of elevator systems by utilizing a logic operation on the basis of digital positional information.

In controlling elevator systems on the basis of the digital logic operation as above described, the detected positional signal indicates the actual position and the actual amount of movement of the associated elevator car. In elevator control systems, an emergency such as an electric power failure may occur which causes a decrease or loss of the control function. Under these circumstances, the emergency suspension is caused to stop the elevator car by the action of the mechanical brake for purposes of safety. However, it is impossible by the operation of the brake to instantaneously stop the associated hoist and elevator car due to their inertias. The car continues to be moved until the braking force overcomes these inertia forces whereupon the car is stopped. Under these circumstances, it is important to know the position of the car within the associated shaft where it has been stopped.

After the end of the particular emergency, conventional elevator control systems have been returned to the normal mode of operation as follows: Because the position of the stopped elevator car is not known, the car has been first moved in a predetermined direction at a predetermined speed according to the automatic operation until it is stopped at a predetermined floor by means of a signal derived from a special position sensor disposed within the associated shaft. Thereafter the car is put in the normal mode of operation. Alternatively, the elevator car has been able to be manually moved to that floor nearest to the position of the stopped car on the basis of the sense of sight until it is stopped at that floor. Then the car is operated in the normal mode. In elevator systems controlled with the digital positional signal without the use of the miniature model as above described, it is necessary to take either one of the abovementioned measures.

SUMMARY OF THE INVENTION

Accordingly it is an object of the present invention to provide a new and improved elevator control system for controlling an elevator car in accordance with a detected digital positional signal therefor so that the car is operative in the normal mode in response to a call simultaneously with the end of an emergency.

The present invention accomplishes this object by the provision of an elevator control system comprising an elevator car, digital position detector means for detecting the amount of movement of the elevator car in a digital manner to produce a digital positional signal, and means for controlling the elevator car in accordance with the digital positional signal wherein there are provided memory means for storing the digital positional signal therein, and a source of electrical energy for operating the memory means even upon the occurrence of an emergency such as an electric power failure.

In a preferred embodiment of the present invention, the elevator control system may comprise a governor sheave operatively coupled to the elevator car, an electric driving motor for vertically moving the elevator car through the governor sheave mounted on its shaft and a rope, pulse generator means disposed on the shaft of the governor sheave to generate a digital positional signal in the form of pulses in response to the actual amount of movement of the elevator car, a control unit for estimating the necessary amount of movement of the elevator car in response to a selected one of a call from within the elevator car and a call from a floor, a logic unit connected to both the pulse generator means and the control unit to effect the arithmetical and comparative operation of the digital positional signal and the necessary amount of movement of the elevator car to produce a digital speed signal, digital-to-analog converter means to convert the digital speed signal to an analog speed signal, motor control unit means connected to the digital-to-analog converter means to control the driving motor in accordance with the analog speed signal, memory means connected to the pulse generator means to store the digital positional signal therein and also connected to the logic unit, and a source of electrical energy for supplying electrical energy to both the memory means and the pulse generator means.

The source of electrical energy may advantageously comprise a storage battery.

BRIEF DESCRIPTION OF THE DRAWING

The present invention will become more readily apparent from the following detailed description taken in conjunction with the accompanying drawing in which.

DESCRIPTION OF THE PREFERRED EMBODIMENT

Figure 1:
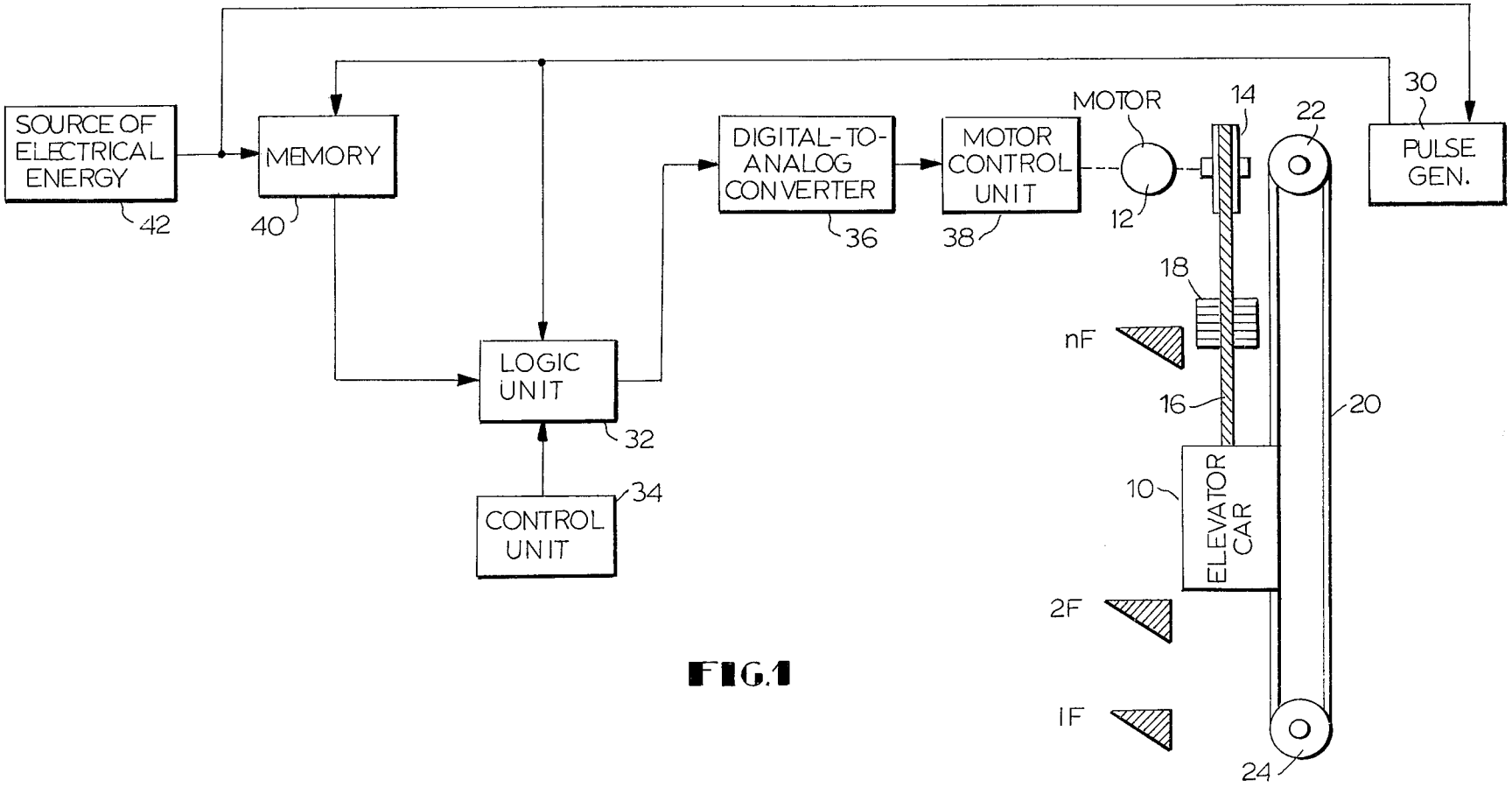
FIG. 1 is a block diagram of an elevator control system constructed in accordance with the principles of the present invention.

Referring now to the drawing and FIG. 1 in particular, it is seen that the arrangement disclosed herein comprises an elevator car 10 and an electric driving motor 12 for vertically moving the elevator car 10 through a traction sheave 14 mounted on the motor shaft and a hoisting rope 16 fixed at one end to the car 10 and reeved over the traction sheave 14 with a counter-weight 18 fixed at the other end of the rope 16. An endless governor rope 20 in the form of a loop is connected at a point on the top and bottom of the elevator car 10 and reeved over a governor sheave 22 and a pulley 24 disposed in the shaft (not shown). The governor sheave 22 is located above the highest point of the travel of the car in the shaft while the pulley 24 is positioned at the bottom of the shaft. Hatched right angle triangles schematically indicate positions of floors of a building in which the arrangement of FIG. 1 is installed and the positions of the first, second and *n*th floors alone are shown by the hatched right-angled triangles 1F, 2F and nF respectively only for purposes of illustration.

The arrangement further comprises a pulse generator 30 mounted on the shaft of the governor sheave 22, a logic unit 32 connected to the pulse generator 30, a control unit 34 connected to the logic unit 32, a digital-to-analog converter 36 connected to the logic unit 32, and a motor control unit 38 connected to the digital-to-analog converter 36 to control the motor 12. The pulse generator 30 is also connected to a memory 40 which in turn is connected to the logic unit 32. A source of electrical energy 42 is connected to both the pulse generator 30 and the memory 40.

In operation, the motor 12 is rotated under control of the motor control unit 38 to move the elevator car 10 in the upward or downward direction through the sheave 14 and the rope 16. The governor sheave 22 is rotated through the governor rope 20 and in response to the movement of the elevator 10 thereby to drive the pulse generator 30. Then the pulse generator 30 provides one pulse for each standard increment of movement of the car 10. The logic unit 32 receives the number of pulses supplied by the pulse generator 30 as the actual amount of movement of the elevator car 10 and is operative to effect the arithmetic and comparative operation of the actual amount of movement of the car and a command amount of movement of the car supplied by the control unit 34 to produce a digital speed signal. The command amount of movement of the car is the result of the estimation effected by the control unit 34 in response to a call from within the car or from any of the floors applied thereto. The digital-to-analog converter 36 converts the digital speed signal from the logic unit 32 to a corresponding analog speed signal. The converted analog signal is supplied to the motor control unit 38 which, in turn, controls the motor 10 until the car is stopped on the desired floor.

Although a standard increment of movement of the car 10 for one pulse may be selected at will, it is preferable to make it as small as possible, in order to increase the accuracy of the elevator control.

In the arrangement of FIG. 1 the elevator car 10 is maintained in the normal mode of operation unless an emergency such as an electric power failure occurs. Once an emergency has occured, the contents of the logic and control units 32 and 34 become unidentified. In addition, a further movement of the elevator car possibly effected due to its inertia after the emergency makes it impossible to determine the actual position of the stopped car within the shaft. In the arrangement of FIG. 1, however, the memory 40 has stored therein the actual amount of movement of the car 10 upon the occurrence of the emergency. Thus simultaneously with the end of the emergency, the logic unit 32 is ready for delivering the next succeeding speed signal by utilizing the content of the memory 40. The content of the memory 40 includes a further movement of the elevator car effected due to its inertia after an emergency such as a power failure because it has been energized by the source 42. In other words, the arrangement of FIG. 1 returns to the normal mode of operation simultaneously with the end of the particular emergency.

Further as the source 42 is required only to supply electrical energy to the memory 40 and the pulse generator 30, the same may be either a storage battery having a low capacity or a direct current generator capable of supplying electrical energy to the memory 40 and the pulse generator 30 only for a time interval between the occurrence of an emergency such as an electric power failure and the complete stoppage of the elevator car.

It is to be noted that with the power supply from the source 42 interrupted for a predetermined time interval, the memory 40 is required to be capable of permanently storing the actual amount of movement of the car from the pulse generator 30. If the source 42 continues to supply electric power during an electric power failure then the memory 40 may temporarily store information from the pulse generator 30.

Figure 2:
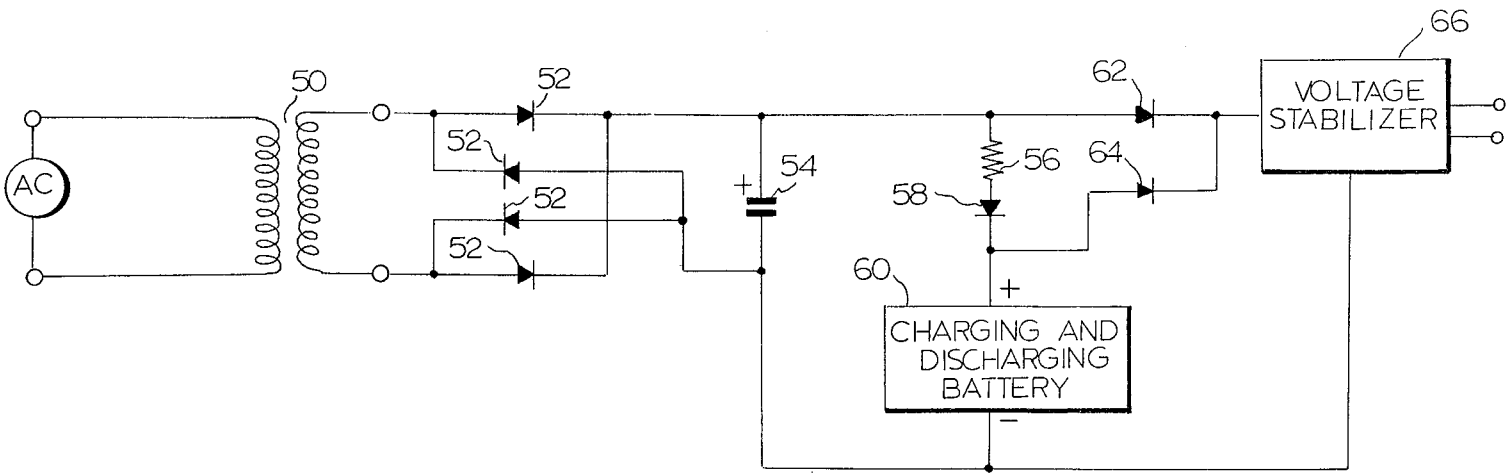
FIG. 2 is a circuit diagram of an example of the source of electrical energy shown in FIG. 1.

Referring now to FIG. 2, there is illustrated a circuit constituting one example of the source 42. As shown in FIG. 2, a source of alternating current AC is connected across a primary winding of a source transformer 50 having a secondary winding connected between a pair of alternating current inputs to a rectifier including four semiconductor diodes 52 interconnected into bridge configuration. The bridge includes a pair of direct current outputs connected across a smoothing capacitor 54 serving to smooth the full-wave rectified voltage from the bridge. The capacitor 54 has a positive side connected to a current limiting resistor 56, which in turn is connected via a semiconductor diode 58 to a charging and discharging storage battery 60 at the positive terminal, and a negative side connected to the negative terminal of the battery 60. Thus the battery is charged through the resistor 56 and the diode 58 from the rectifier formed of the four diodes 52 with the resistor 56 serving to limit the maximum charging current.

The capacitor 54 is also connected on the positive side to a semiconductor diode 62 which is, in turn, connected to a voltage stabilizer 66. The positive terminal of the battery 60 is also connected to the voltage stabilizer 66 through a semiconductor diode 64 while the negative terminal of the battery 60 is connected to a corresponding terminal of the voltage stabilizer 66.

It is assumed that, with the source of alternating current AC operated in the normal mode, the voltage across the capacitor 56 is higher than the voltage across the battery 60 which has been fully charged. Under the assumed condition, the capacitor 54 supplies an input to the voltage stabilizer 66 through the diode 62 while it is charging the battery 60 through the resistor 56 and the diode 58.

On the other hand, if the source of alternating current Ac decreases or fails to supply electric power to the source transformer 50, the voltage across the capacitor 56 becomes less than that across the battery 60. Under these circumstances, the battery 60 rather than the capacitor 56 supplies the input to the voltage stabilizer 60.

From the foregoing, it will be appreciated that the voltage stabilizer 66 continues to supply electric power in the normal mode of operation and can supply the power for a predetermined time interval after the occurrence of an emergency such as an electric power failure.

If the battery 60 cannot be charged, the resistor 56 and the diode 58 may be omitted. This is true in the case where a direct current generator is used.

While the present invention has been illustrated and described in conjunction with a single preferred embodiment thereof it is to be understood that various changes and modifications may be resorted to without departing from the spirit and scope of the present invention.

What is claimed is:

1. An elevator control system comprising, in combination, an elevator car, a traction sheave operatively coupled to said elevator car, an electric driving motor coupled to said traction sheave for vertically moving said elevator car, a governor sheave operatively coupled to said elevator car and having a shaft, pulse generator means disposed on the shaft of said governor sheave for generating a digital positional signal in the form of pulses in response to the actual amount of movement of the elevator car, a control unit for estimating the amount of movement of the elevator car necessary in response to a selected one of a call from within said elevator car and a call from a floor, a logic unit connected to both said pulse generator means and said control unit for effecting the arithmetical and comparative operation of said digital positional signal and said needed amount of movement of the elevator car to produce a digital signal, digital-to-analog converter means connected to said logic unit to convert said digital speed signal to an analog speed signal, motor control unit means connected to said digital-to-analog converter means and to said driving motor for controlling said driving motor in accordance with said analog speed signal, memory means connected to said pulse generator means to store said digital positional signal therein and also connected to said logic unit, and a source of electrical energy for supplying electrical energy to both said memory means and said pulse generator means during a failure of the normal power supply to said elevator control system, whereby when the normal power supply fails, said source of electrical energy supplies power to said pulse generator means and said memory means and said pulse generator means continues to generate digital position signals until the elevator car slows to a stop due to inertia thereof, and said memory means stores said digital position signals, and thereby when the normal power supply is restored the control system has available from said memory means the exact position of the stopped elevator car.

2. An elevator control system as claimed in claim 1 wherein said source of electrical energy comprises a storage battery.

3. An elevator control system as claimed in claim 1 wherein said source of electrical energy comprises a direct current generator.

* * * * *